United States Patent [19]

Klammer et al.

[11] Patent Number: 4,555,233

[45] Date of Patent: Nov. 26, 1985

[54] SHOCK-ABSORBING BOW MOUNT FOR TROLLING MOTOR

[75] Inventors: Mark S. Klammer; Del P. Decko, both of Mankato, Minn.

[73] Assignee: Johnson Fishing, Inc., Mankato, Minn.

[21] Appl. No.: 602,772

[22] Filed: Apr. 23, 1984

[51] Int. Cl.[4] ..... B63H 21/26

[52] U.S. Cl. ..... 440/56; 440/6; 440/53; 440/65

[58] Field of Search ..... 440/56, 53, 55, 62, 440/64, 65, 6, 76

[56] References Cited

U.S. PATENT DOCUMENTS

| | | | |
|---|---|---|---|
| 1,890,938 | 12/1932 | Fahrney | 440/56 |
| 1,990,387 | 2/1935 | Linthwaite | 440/56 |
| 3,460,506 | 8/1969 | Johns | 440/56 |
| 3,470,844 | 10/1969 | Johns | 440/56 |
| 4,033,530 | 7/1977 | Harris | 440/56 |
| 4,129,088 | 12/1978 | Foley | 440/6 |
| 4,154,417 | 5/1979 | Foley | 440/6 |

*Primary Examiner*—Trygve M. Blix
*Assistant Examiner*—C. T. Bartz

[57] ABSTRACT

An electric trolling motor mounting device having improved shock-absorbing capabilities. The device includes a substantially vertical bearing surface and a tube-securing element for holding the vertical tube structure which supports the motor under water, such tube-securing element being attached to the bearing surface by a two-dimensional array of horizontal compressible shock absorbers having springs held in compression between the bearing plate and the tube-securing element. A two-by-two array of four shock absorbers using coil springs is preferred. Bolts extending concentrically through the springs and each having one slideable and one fixed connection are the preferred structure, as are recesses receiving the ends of the coils.

7 Claims, 6 Drawing Figures

SHOCK-ABSORBING BOW MOUNT FOR TROLLING MOTOR

FIELD OF THE INVENTION

This invention is related generally to electric trolling motors of the type mounted on the bow of a fishing boat and more specifically to bow-mounting devices capable of absorbing shock caused when the motor strikes underwater objects.

BACKGROUND OF THE INVENTION

The use of electric trolling motors on fishing boats has grown dramatically in recent years. It is now commonplace to use two propulsion means—a gasoline outboard to get to and from the fishing site and a much quieter electric trolling motor for maneuvering at the site, resisting current, or trolling.

In many cases, the electric trolling motor is suspended from a mounting structure which is attached to the boat near its bow, usually on a small forward deck surface. Whatever the nature of the mounting equipment, the electric motor is normally suspended in its operative position at the bottom of a vertical tube structure held just beyond the edge of the boat. The tube structure usually has an outer tube which is gripped nonrotatably by a portion of the mounting bracket, and a rotatable tube inside the outer tube which may be turned within the outer tube to set the direction of the motor attached at the bottom end thereof.

Since the electric motor is suspended underwater, it often strikes submerged objects, such as rocks. Such collisions may be quite damaging to the motor and to the mounting structure.

A variety of devices have been developed to absorb the shock of underwater collisions involving submerged motors and portions thereof. The prior United States patents include U.S. Pat. Nos.: 1,460,570; 1,523,909; 1,559,616; 1,780,552; 1,890,938; 1,990,387; 2,713,842; 2,957,441; 2,972,977; 3,003,724; 3,075,490; 3,246,915; 3,347,540; 3,460,506; 3,470,844; 3,698,673; 3,915,417; 3,948,472; 4,009,900; and 4,033,530.

The shock-absorbing devices of the prior art have a number of drawbacks and deficiencies. For example, the device disclosed in U.S. Pat. No. 3,915,417 allows pivoting movement of an electric trolling motor striking a submerged object when the boat is moving forward, but not when the boat is moving backwards. A spring device mounted in a substantially horizontal member of such device is extensible, but not compressible.

The devices disclosed in U.S. Pat. Nos. 3,470,844 and 1,523,909 each have two horizontal springs which absorb some shock, but fail to provide shock absorbing in several directions. In some cases, connecting devices limit the degrees of freedom of some shock-absorbers and limit their potential usefulness with electric trolling motors.

U.S. Pat. No. 1,780,552 discloses a two-by-two array of vertically disposed springs. While such a device allows a motor to rise over a submerged object exerting force against the bottom of the motor, little or no shock-absorbing movement in a horizontal direction, as is more typically needed, would be provided. Indeed, the springs would not ever undergo compression when an object is struck.

In short, there has been a need for an improved shock-absorbing mount for an electric trolling motor. A mount capable of absorbing shock which is taken through the vertical shaft structure in various directions is needed.

BRIEF SUMMARY OF THE INVENTION

This invention is in an electric trolling motor mounting device of the type having means for attachment to a boat, such as a folding extendible-retractable mounting bracket, a tube-securing element connected to such attachment means, and a tube structure held by the tube-securing element and having the electric motor at one end thereof for suspension under water during operation.

The trolling motor mounting bracket of this invention has, as part of the apparatus attached to the boat, a substantially vertical bearing surface adjacent to the tube-securing element. The tube-securing element is attached to the bearing surface by a two-dimensional array of substantially horizontally oriented compressible shock absorbers having springs held in compression between the bearing surface and the tube-securing element. The springs are compressible, but are not expansible. When not absorbing shock, the springs are held at a maximum length.

The springs are preferably coil springs and the array is preferably a two-by-two array of four shock absorbing springs, preferably a rectangular array. In preferred embodiments the springs are held in compression by bolts which extend slideably through either the vertical bearing surface or the tube-securing element, concentrically through the coil springs, and into fixed engagement with the other of the vertical bearing surface or tube-securing element. Preferably, the bolts extend slideably through the bearing surface and are fixed firmly into the tube-securing element.

The opposed bearing surface and the tube-securing element have, for each spring and bolt combination, opposed recessed areas dimensioned to receive the ends of the coil spring. This serves to maintain the bolts and springs in concentric relationship one to the other.

The tube-securing element of the device of this invention preferably has two semi-cylindrical portions which are clamped together to secure the tube structure and which may be opened to remove the tube structure and its attached motor. This allows easy disassembly of the device.

The trolling motor mounting bracket of this invention has improved shock-absorbing characteristics. Whether the electric motor is driving in the forward direction or the backward direction, the shock of an impact thereon can be absorbed by the device of this invention. This is due at least in part to the vertical orientation of the bearing surface, the horizontal orientation of the springs, and the fact that the array of springs is two-dimensional. Furthermore, the device is not hampered by additional limiting or restraining mechanical means and the shock-absorbing springs can function freely.

When the impact is from the forward direction, the lower spring or springs will be compressed to absorb the shock while the higher spring or springs cannot expand and their bolts and surrounding structure provide a point about which the entire vertical structure may pivot. When the impact is from the rear, the upper spring or springs will be compressed to absorb the shock while the lower spring or springs cannot expand and their bolts and surrounding structure provide a point about which the entire vertical structure may pivot.

When the impact is taken at an angle, the shock-absorbing device of this invention can accommodate the shock by differing amounts of compression being taken by different springs in the array. Other than the shock absorbing bolt and spring structures, there is no restricting or limiting structure which limits the effectiveness of the device of this invention.

The device of this invention, in addition to absorbing shocks caused by underwater collisions, serves to control the high initial thrust of the more powerful electric trolling motors, even though such thrust is taken in various directions to the boat as determined by the direction of the motor.

OBJECTS OF THE INVENTION

An object of this invention is to provide an improved shock-absorbing mounting device for electric trolling motors.

Another object of this invention is to provide a shock-absorbing mounting device having multiple degrees of freedom to accommodate collisions of the motor with submerged obstacles while the boat is traveling either forwards or backwards or in various directions therebetween.

Another object of this invention is to provide a shock-absorbing mounting device which can control the initial thrust of a powerful electric trolling motor, although taken in various directions.

These and other important objects will be apparent from the following description of preferred embodiments of the invention and from the accompanying drawings wherein:

DETAILED DESCRIPTION OF PREFERRED EMBODIMENTS

Figure 2:
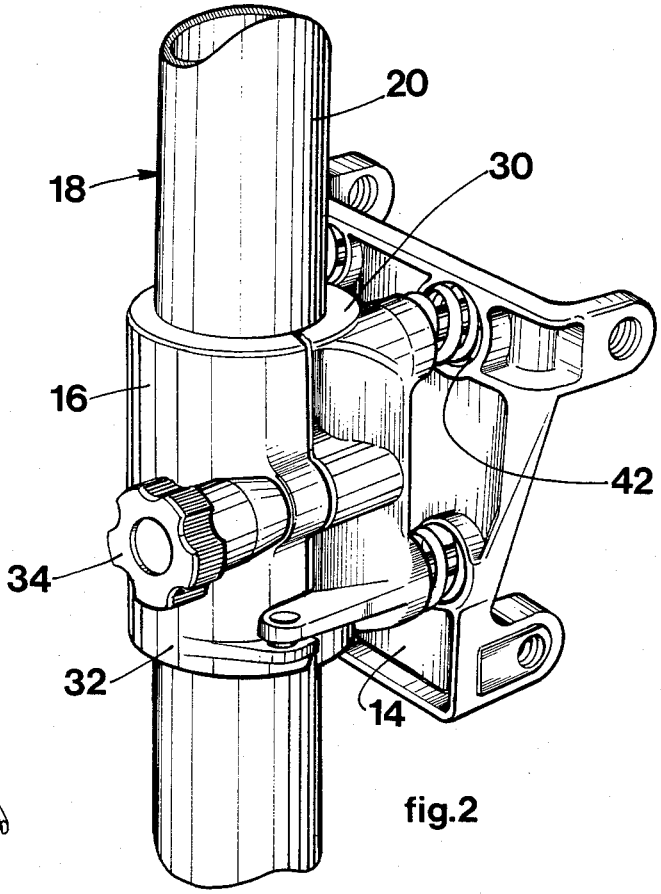
FIG. 2 is an enlarged fragmentary perspective view of FIG. 1, showing portions of the mounting device.
Figure 1:
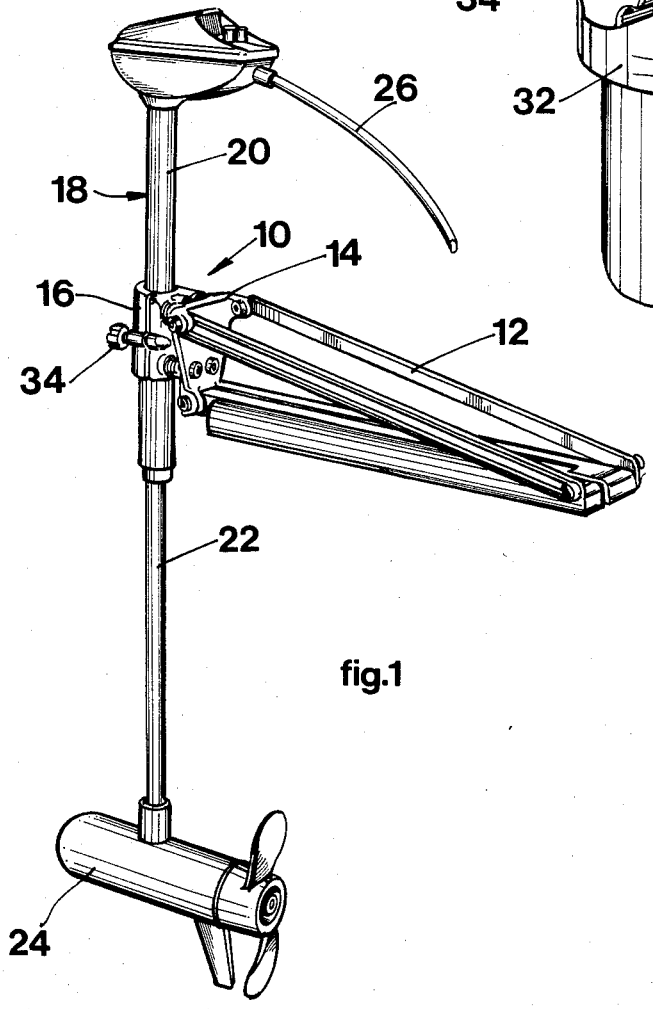
FIG. 1 is a perspective view of an electric trolling motor with its mounting device and related equipment.

The figures illustrate an electric trolling motor mounting device 10 in accordance with this invention, together with related equipment. The device is shown in the extended "in-water" orientation.

Bracket 12 is intended for attachment to the foredeck of a fishing boat, and can be retracted to allow the motor to rest on the foredeck. Forming the end of bracket 12 is a substantially vertical bearing surface or plate 14. Attached to plate 14, through shock-absorbing means hereafter described, is a tube-securing element 16.

Tube-securing element 16 holds a tube structure 18 in vertical orientation. Tube structure 18 includes a fixed outer tube 20, which is gripped by tube-securing element 16, and a rotatable inside tube 22. Attached to inside tube 22 at the bottom thereof is the electric motor 24. Control cables 26 extend from a control device not shown to a turning device (not shown) inside a headbox which turns inside tube 22, and hence motor 24, to different directions with respect to the boat.

Figure 4:
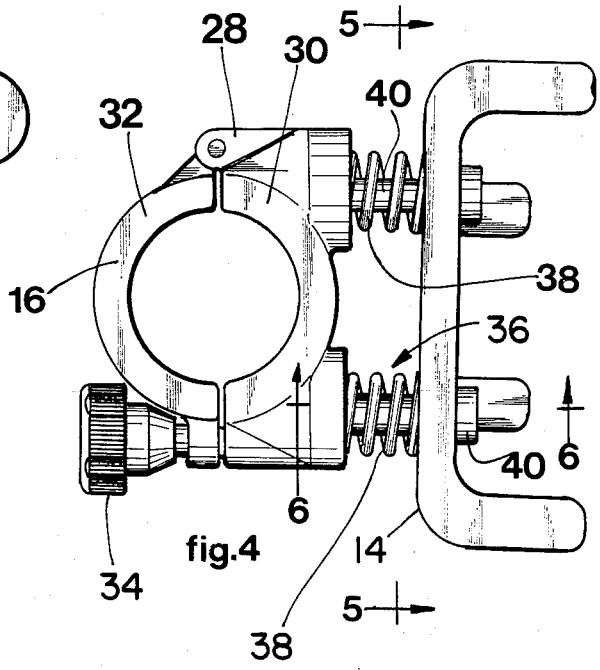
FIG. 4 is a top view of FIG. 3.

As illustrated best in FIG. 4, tube-securing element 16 has two semi-cylindrical portions 30 and 32 hinged together by hinge 28, allowing outer tube 20 to be clamped therebetween by closing the portions 30 and 32 and tightening hand bolt 34.

FIGS. 2–6 best illustrate this invention, which deals primarily with the interconnection of tube-securing element 16 and vertical plate 14. Element 16 and plate 14 are connected together by a two-dimensional array of shock absorbers 36, each having a coil spring 38 and a bolt 40.

"Two-dimensional" refers to the arrangement of shock absorbers on vertical plate 14, requiring that they not be arranged across plate 14 in a line. Furthermore, this two-dimensional requirement indicates that there are at least three such shock absorbers. An two-by-two array of four such shock absorbers is preferred, and such arrangement is preferably rectangular.

Each of springs 38 is held in compression between bearing plate or surface 14 and tube-securing element 16. Bolts 40, which extend concentrically through coil springs 38, fix the maximum distance possible between surface 14 and element 16. Bolts 40 extend slideably through vertical plate 14 and are in fixed engagement with tube-securing element 16, in a position substantially compressing springs 38.

Figure 6:
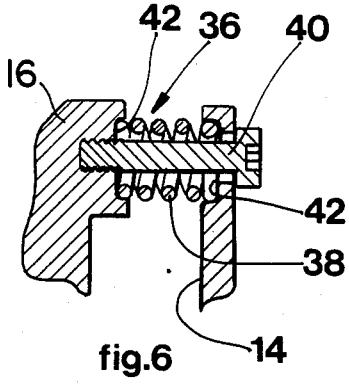
FIG. 6 is a fragmentary sectional view taken along section 6—6 as indicated in FIG. 4.

FIG. 6 shows additional detail of shock absorbers 36. Tube-securing element 16 and vertical surface 14 have opposed recesses 42 dimensioned to receive the ends of a spring 38. This helps to hold springs 38 in concentric relationship with bolt 40 extending therethrough.

Figure 3:
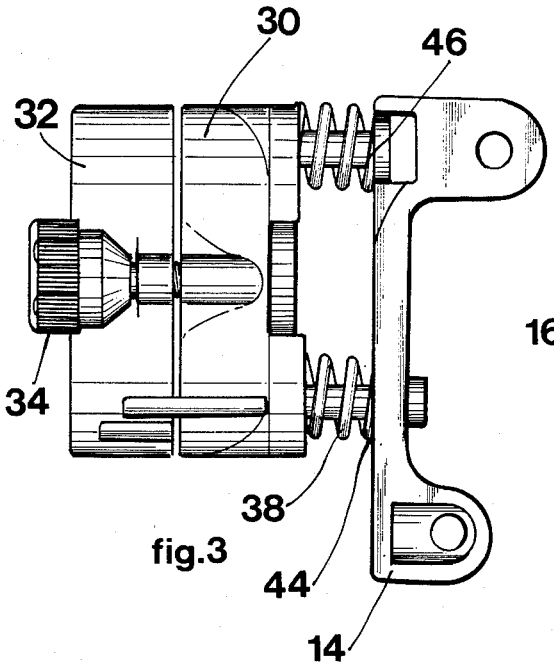
FIG. 3 is a side elevation of FIG. 2.
Figure 5:
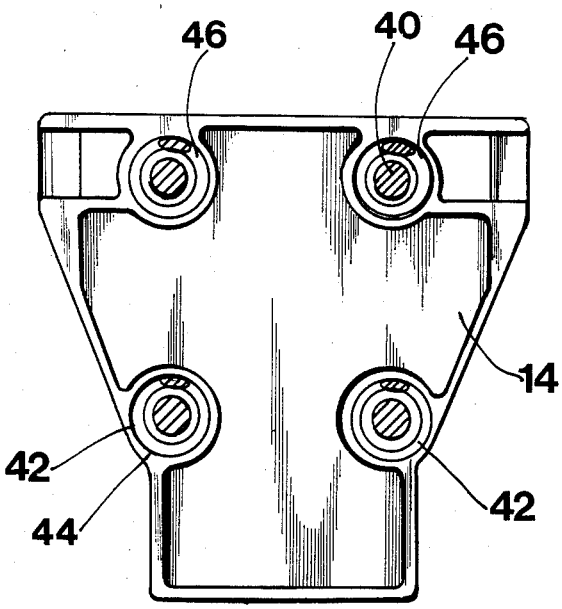
FIG. 5 is a sectional view taken along section 5—5 as indicated in FIG. 4.

Referring to FIGS. 3 and 5, lower shock absorbers 44 and upper shock absorbers 46 will function differently depending on what direction the boat is traveling when motor 24 hits a submerged object.

If the boat is moving forward, lower shock absorbers 44 will be compressed as tube structure 18 tilts with the impact. Upper shock absorbers 46 will function as pivot points for such tilting of tube structure 18 with respect to vertical plate 14 and the boat. If, however, the boat is moving backward, upper shock absorbers 46 will be compressed and lower shock absorbers 44 will function as pivot points for the tilting of tube structure 18.

Because of the great leverage provided by the length of tube structure 18 when motor 24 collides with a submerged object, the compression of springs 38 must be made substantial in order for them to function properly as shock absorbers. Persons skilled in the art who are made familiar with this invention can select appropriate springs and compression amounts for proper functioning.

While in the foregoing specification this invention has been described in relation to certain preferred embodiments and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In an electric trolling motor mounting device of the type having means for attachment to a boat, a tube-securing element connected to said attachment means and a tube structure held by the tube-securing element and having the motor at one end thereof for under water suspension during operation, the improvement, described in the in-water orientation, wherein:

said attachment means includes a substantially vertical bearing surface adjacent the tube-securing element;

an array of compressible springs held in partial compression between said bearing surface and said tube-securing element, said array being constituted by a group of at least two such springs disposed in spaced horizontal orientation and a second group including at least a third spring vertically spaced from a line between centers of the springs of said first group of springs; and means associated with said attachment means and said tube-securing element to permit said tube-securing element to tilt relative to said vertical bearing surface upon the application of a lateral force to the motor;

whereby the shock of collisions between the motor and underwater objects may be absorbed by tilting of said tube structure and tube securing element relative to said bearing surface to compress the springs of one of said groups.

2. The trolling motor mounting device of claim 1 wherein the springs are coil springs.

3. The trolling motor mounting device of claim 1 wherein said second group includes at least two springs horizontally spaced apart.

4. The trolling motor mounting device of claim 3 wherein the springs are coil springs.

5. The trolling motor mounting device of claim 2 or 3 wherein the springs are held in compression by bolts extending slideably through one of the bearing surface and the tube-securing element and concentrically through the springs into fixed engagement with the other of the bearing surface and the tube-securing element.

6. The trolling motor mounting device of claim 5 wherein the bolts extend slideably through the bearing surface and are in fixed engagement with the tube-securing element.

7. The trolling motor mounting device of claim 5 wherein the bearing surface and the tube-securing element have, for each spring and bolt combination, opposed recessed areas dimensioned to receive the ends of the coil spring.

* * * * *